US009479867B2

(12) United States Patent
Li

(10) Patent No.: US 9,479,867 B2
(45) Date of Patent: Oct. 25, 2016

(54) METHOD AND CIRCUITRY FOR DIRECTION OF ARRIVAL ESTIMATION USING MICROPHONE ARRAY WITH A SHARP NULL

(71) Applicant: Texas Instruments Incorporated, Dallas, TX (US)

(72) Inventor: Yunhong Li, Santa Clara, CA (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 94 days.

(21) Appl. No.: 14/323,560

(22) Filed: Jul. 3, 2014

(65) Prior Publication Data

US 2015/0016628 A1 Jan. 15, 2015

Related U.S. Application Data

(60) Provisional application No. 61/844,965, filed on Jul. 11, 2013.

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01)

(58) Field of Classification Search
None
See application file for complete search history.

(56) References Cited

U.S. PATENT DOCUMENTS

2001/0028720 A1* 10/2001 Hou ..... H04R 1/406 381/92
2005/0213432 A1* 9/2005 Hoshuyama ..... H04M 1/03 367/129
2011/0200205 A1* 8/2011 Tokuda ..... G10L 21/0208 381/92
2014/0241549 A1* 8/2014 Stachurski ..... H04M 3/568 381/92

FOREIGN PATENT DOCUMENTS

WO WO 0037962 * 6/2000

OTHER PUBLICATIONS

H. Krim et al., "Two Decades of Array Signal Processing Research—The Parametric Approach," Jul. 1996, IEEE Signal Processing Magazine, pp. 67-94.

* cited by examiner

*Primary Examiner* — Regina N Holder
(74) *Attorney, Agent, or Firm* — Michael A. Davis, Jr.; Frank D. Cimino

(57) ABSTRACT

A device is configured for identifying a direction of a sound. The device includes a controller comprising circuitry. The circuitry is configured to receive a first output from a first input device and a second output from a second input device. The circuitry is also configured to add a delay to the second output. The circuitry is also configured to compare the first output to the delayed second output in a plurality of directions to form a comparison. The circuitry is also configured to identify a number of null directions of the plurality of directions where a set of nulls exists based on the comparison.

20 Claims, 6 Drawing Sheets

METHOD AND CIRCUITRY FOR DIRECTION OF ARRIVAL ESTIMATION USING MICROPHONE ARRAY WITH A SHARP NULL

CLAIM OF PRIORITY

This application claims priority of U.S. Patent Application Ser. No. 61/844,965 entitled "METHOD AND SYSTEM FOR DIRECTION OF ARRIVAL ESTIMATION USING MICROPHONE ARRAY WITH SHARP NULL," filed Jul. 11, 2013, the contents of which are incorporated herein by reference in their entirety.

TECHNICAL FIELD

This disclosure is generally directed to direction of arrival estimation and more particularly to identifying sharp nulls in space.

BACKGROUND

In signal processing, Direction of Arrival (DOA) denotes the direction from which a wave (usually a propagating wave) arrives at a point, where a set of sensors may be located. This set of sensors form what is called a sensor array. DOA estimation methods may rely on a sensor array, and many methods exist with variations in complexity and estimation accuracy.

One type of relatively simple method is based on beamforming. Beamforming may help in estimating the signal from a given direction. In such a method, a steerable beam is formed towards the angle of interest by applying a complex set of weights to each array element. The DOA of the signal can be discovered by steering the beam through all possible angles of interest, and the angle that has the maximum energy output is considered to be the DOA of the signal.

The accuracy of these methods depends on the width of the beam, which is determined by factors such as the number of array elements and the physical size of the entire array. Narrower beam width can be achieved by increasing array elements and/or enlarging the array size. Additionally, the beam width is inversely proportional to the working frequency of the array, i.e., at lower frequencies the beam width is wider and hence poorer estimation accuracy. Such inconsistent performance over frequencies becomes a problem when the signal of interest is broadband.

SUMMARY

One or more embodiments provide a device for identifying a direction of a sound. The device includes a controller comprising circuitry. The circuitry is configured to receive a first output from a first input device and a second output from a second input device. The circuitry is also configured to add a delay to the second output. The circuitry is also configured to compare the first output to the delayed second output in a plurality of directions to form a comparison. The circuitry is also configured to identify a number of null directions of the plurality of directions where a set of nulls exists based on the comparison.

One or more embodiments provide a method for identifying a direction of a sound. The method includes receiving a first output from a first input device and a second output from a second input device. The method also includes adding a delay to the second output. The method also includes comparing the first output to the delayed second output in a plurality of directions to form a comparison. The method also includes identifying a number of null directions of the plurality of directions where a set of nulls exists based on the comparison.

DETAILED DESCRIPTION

Figure 1:
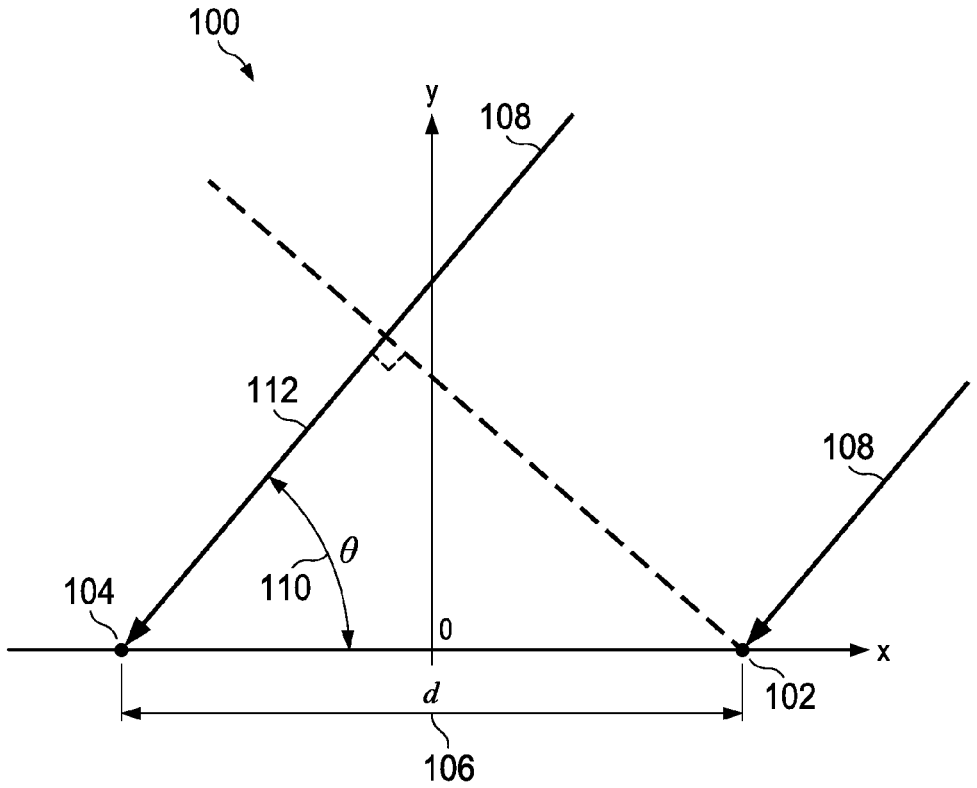
FIG. 1 is a schematic view of a microphone array geometry for capturing audio signals of an illustrative embodiment.

FIG. 1 shows a microphone array geometry, indicated generally at 100, for capturing audio signals of an illustrative embodiment. FIG. 1 illustrates a geometry where two microphones are used. The geometry includes microphone 102, microphone 104, spacing d 106, source signal 108, and angle 110 of the direction of arrival of source signal θ. If the source is in an x-y plane then the DOA of the source signal is denoted by the angle θ with respect to the x-axis.

In an example embodiment, the distance d 106 is chosen to be less than the wavelength of the highest frequency of interest or threshold frequency.

In an embodiment, the source is in the far field. Due to the distance, the signals received by the two microphones have substantially the same incoming angle. The difference in the traveling path of the two microphone signals is d cos $\theta_0$ as can be seen from FIG. 1.

The path difference introduces mostly time delay in the microphone signals, while, in an example, the amplitude difference can be ignored when a far-field model is assumed. In one embodiment, the amount of the delay is:

$$\tau x(\theta) = \frac{d\cos\theta}{v}, \tag{1}$$

where v is the speed of the sound.

Figure 2:
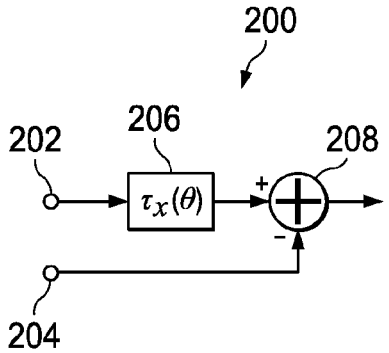
FIG. 2 is a block diagram of a system with a delay and subtractor for a microphone pair of an illustrative embodiment.

FIG. 2 shows a system with a delay and subtractor, indicated generally at 200, for a microphone pair of an illustrative embodiment. FIG. 2 illustrates a system 200 where two microphones are used. The system 200 includes microphone 202, microphone 204, delay unit 206, and subtractor unit 208. The system 200 can also include a processor or controller unit (not shown) as well as a memory element (not shown) coupled to delay unit 206 and subtractor unit 208. Delay unit 206 and subtractor unit 208 can be implemented by circuitry. Both microphones 202 and 204 receive an input of audio signals and output digital or analog signals.

In an embodiment, system 200 is operable to apply, using delay unit 206, the same or substantially the same amount of delay of microphone 204 electrically to the signal from microphone 202. In other words, delay unit 206 anticipates the delay in microphone 204 and adds the anticipated delay to the output signal from microphone 202.

Subtractor unit 208 is operable to subtract the output signal from microphone 204 from the output signal of the modified output signal of microphone 202. In effect, any sounds with a DOA of θ are removed from the final output. In an example, some constraint on the array spacing d can be used to limit possible spatial aliasing, i.e., to prevent nulls from appearing in undesirable locations.

In an example embodiment, a tone signal arrives from an angle of θ, $0<\theta<\pi$. The signal received by microphone 202, before the delay unit 206, can be denoted by sin(2πft), which results in:

$$s_1=\sin\,[2\pi f(t-\tau_x(\theta_0))], \tag{2}$$

and $$s_2=\sin\,[2\pi f(t-\tau_x(\theta))], \tag{3}$$

where f is the frequency of the tone.

The value of $s_1-s_2$ will be zero whenever θ satisfies the following relationship:

$$\tau_x(\theta)=\tau_x(\theta_0)\pm 2m\pi, m=0,\pm 1,\pm 2. \tag{4}$$

Putting (1) into (4) yields:

$$\cos\theta = \cos\theta_0 \pm \frac{m\lambda}{d},\ m = 0,\ \pm 1,\ \pm 2, \tag{5}$$

where λ is the wavelength of the tone and $$\lambda = \frac{v}{f}$$

is used here.

Equation (5) has a solution $\theta=\pm\theta_0$ when m=0. Further, depending on values of $\theta_0$, d and m, θ may have other solutions, which create additional nulls in the array beam pattern. As described herein, nulls are used to detect the incoming angle of a signal. The embodiments recognize and take into account that limiting the nulls generated by a microphone pair to $\theta=\pm\theta_0$ increases accuracy of detection. Decreasing the nulls can be achieved by letting d satisfy the following condition, $$\cos\theta_0 \pm \frac{m\lambda}{d} > 1 \text{ and } \cos\theta_0 \pm \frac{m\lambda}{d} < -1,\ m = \pm 1,\ \pm 2. \tag{6}$$

It follows that d only needs to satisfy the following inequality to satisfy (6), $$\cos\theta_0 + \frac{\lambda}{d} > 1 \text{ and } \cos\theta_0 - \frac{\lambda}{d} < -1. \tag{7}$$

Solving the above inequality yields $$d < \frac{\lambda}{2}.$$

Hence it the array spacing is less than half of the wavelength of the working frequency, only two nulls will appear at $\theta=\pm\theta_0$. The frequency $$f_H = \frac{\lambda}{2d}$$

will be referred as the highest working frequency for the microphone pair. As long as the incoming signal's frequency is less than $f_H$, the null position is fixed since the delay amount is independent of frequency as can be seen from Equation (1).

Figure 3:
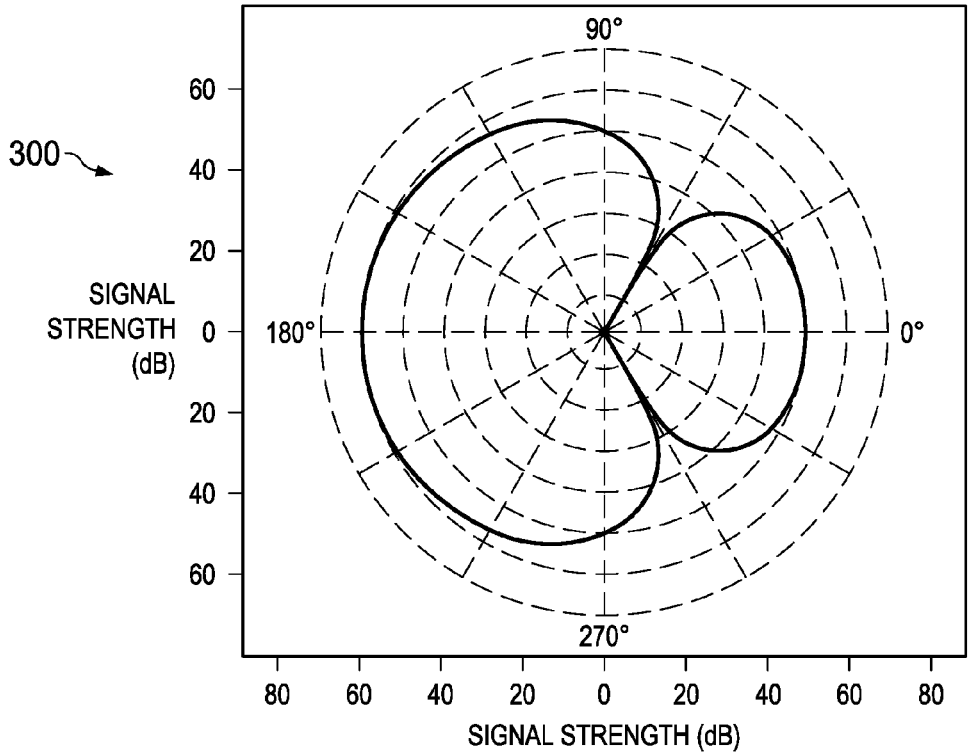
FIG. 3 is a graph of a beam pattern of an illustrative embodiment.

FIG. 3 shows a beam pattern, indicated generally at 300, of an illustrative embodiment. FIG. 3 illustrates beam pattern 300 where two microphones are used. Beam pattern 300 is plotted on an x-y graph with signal strength (dB) of one of the microphones along the y-axis and the signal strength (dB) of the second microphone along the x-axis.

As an example, beam pattern 300 of the microphone array 200 in FIG. 2 is shown in FIG. 3. In an example, when nulls are generated at $\theta=\pm 60°$, there is a signal entering through either one of the nulls. The microphone array 200 in FIG. 2 does not distinguish which of the two nulls is the originating signal. Output from the microphone pair can be substantially lower compared to that of a reference microphone.

Figure 4:
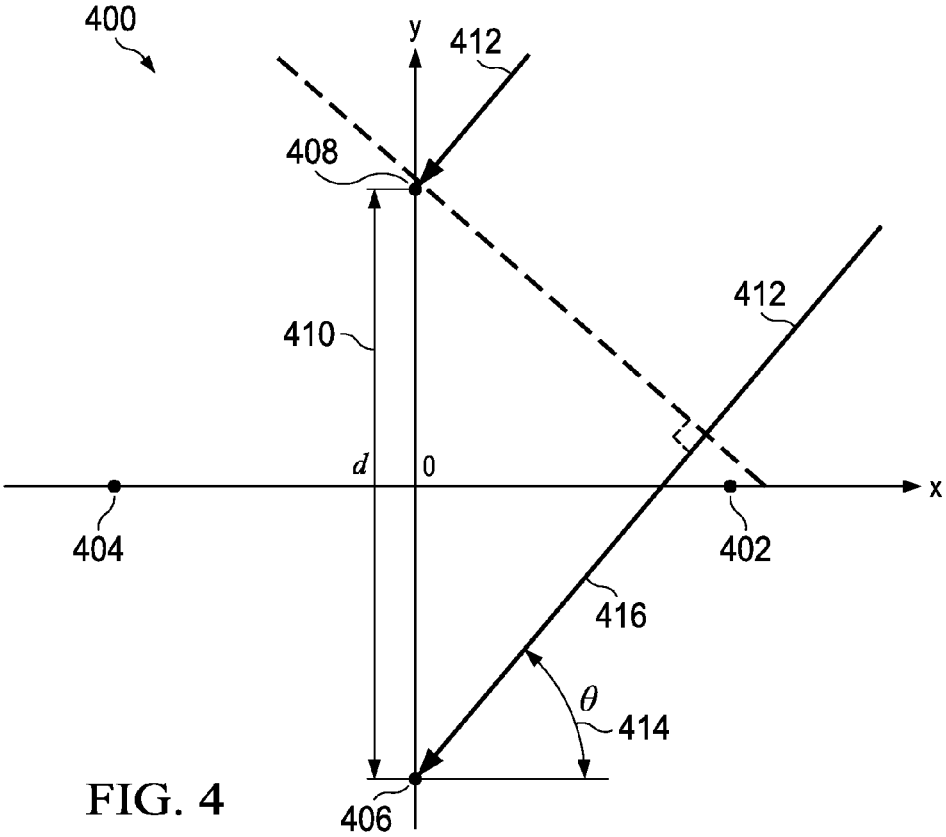
FIG. 4 is a schematic view of a microphone array geometry with two microphone pairs, indicated generally at 400, for capturing audio signals of an illustrative embodiment.

FIG. 4 shows the microphone array geometry with two microphone pairs, indicated generally at 400, for capturing audio signals of an illustrative embodiment. FIG. 4 illustrates a geometry where two microphone pairs are used. The geometry includes microphone 402, microphone 404, microphone 406, microphone 408, spacing d 410, source signal 412, and angle of direction θ 414 of arrival of source signal. If the source is in an x-y plane then the DOA of the source signal is denoted by the angle θ with respect to the x-axis.

In an example embodiment, the distance d 410 is chosen to be less than the wavelength of the highest frequency of interest or threshold frequency. The source is in the far field. Due to the distance, the signals received by the two microphones have substantially the same incoming angle.

In an example embodiment, to narrow the DOA between the two nulls of the one dimensional array as shown in beam pattern 300 in FIG. 3, a second microphone pair, microphones 406 and 408, is added on y-axis. Similarly, a time delay 416 exists between the two output signals of microphones 406 and 408.

Figure 5:
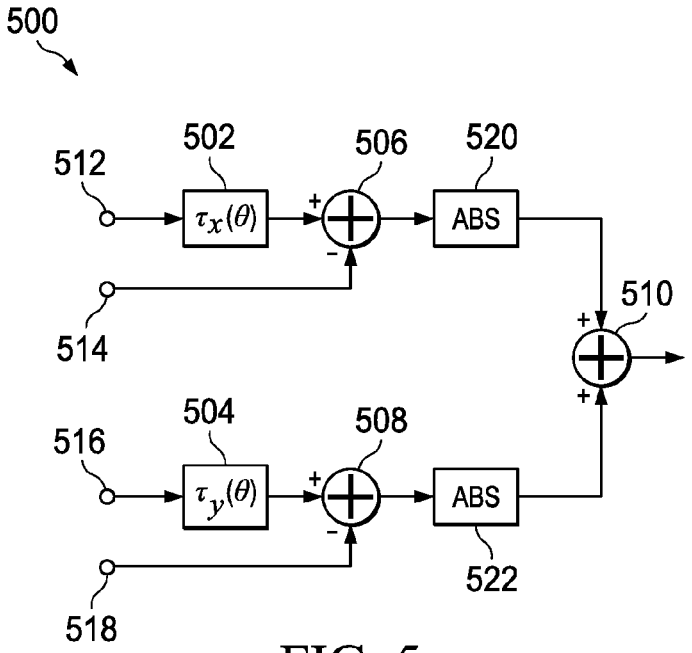
FIG. 5 is a block diagram of a system with delay units and subtractor units with two microphone pairs of an illustrative embodiment.

FIG. 5 shows a system 500 with delay units and subtractor units with two microphone pairs of an illustrative embodiment. FIG. 5 illustrates system 500 where four microphones (two pair) are used. The system 500 includes delay units 502 and 504, subtractor units 506 and 508, adder unit 510, microphones 512-518, and absolute value units 520 and 522.

The system 500 can also include a processor or controller unit (not shown) as well as a memory element (not shown) coupled to one or more of delay units 502 and 504, subtractor units 506 and 508, adder unit 510, and absolute value units 520 and 522. Delay unit units 502 and 504, subtractor units 506 and 508, adder unit 510, and absolute value units 520 and 522 can be implemented by circuitry. For example, the systems of the illustrative embodiments include various electronic circuitry components for automatically performing the systems' operations, implemented in a suitable combination of software, firmware and hardware, such as one or more digital signal processors ("DSPs"), microprocessors, discrete logic devices, application specific integrated circuits ("ASICs"), and field-programmable gate arrays ("FPGAs"). Microphones 512-518 receive an input of audio signals and output digital signals.

In an embodiment, system 500 is operable to apply, using delay unit 502, the same or substantially the same amount of delay of microphone 514 electrically to the signal from microphone 512. In other words, delay unit 502 anticipates the delay in microphone 514 and adds the anticipated delay to the output signal from microphone 512.

Similarly, system 500 is operable to apply, using delay unit 504, the same or substantially the same amount of delay of microphone 518 electrically to the signal from microphone 516. In other words, delay unit 504 anticipates the delay in microphone 518 and adds the anticipated delay to the output signal from microphone 516. System 500 may be referred to herein as a null generating block.

Subtractor unit 506 is operable to subtract the output signal from microphone 514 from the modified output signal of microphone 512. In effect, any sounds with a DOA of θ are removed from the final output.

Subtractor unit 508 is operable to subtract the output signal from microphone 518 from the modified output signal of microphone 516. In effect, any sounds with a DOA of θ are removed from the final output.

Absolute value units 520 and 522 are operable to obtain the absolute values from the outputs of subtractor units 506 and 508, respectively. Adder unit 510 is operable to add the outputs from absolute value units 520 and 522 to obtain a final output.

In an embodiment, described in operational terminology, system 500 is operable to generate a single null in an x-y plane. The location of the null can be adjusted by changing the amount of delay applied to individual microphone output. For example, system 500 is an example system to detect angles between 0° and 90°. System 500 assumes the signal received by microphones 514 and 518 are lagging behind signals received by microphones 512 and 516, respectively. Accordingly, delay units 502 and 504 are applied after microphones 512 and 516. To detect angles in other ranges, delay units 502 and 504 can be moved to any two of the microphones 512-518.

A direction finding system can be built by implementing a number of such systems in parallel, with each system generating a null at a different direction. One or more embodiments recognize and take into account that position of the null is independent of frequency, so that it is very suitable for broadband applications. Whenever a sound event occurs, the system that has a null nearest to the arriving angle of the sound event will generate a substantially lower level output compared to all other systems. Hence the direction of the sound event can be identified.

In another embodiment, instead of implementing the null-generating system in parallel, a direction finding system can also implement a single system with its delay value changed in a predetermined serial sequence, resulting in a direction finding system that scans all angles of interest in serial.

One or more embodiments provide a system structure that is flexible for either analog or digital implementation. Parallel processing is particular suitable for analog circuit implementation, which can achieve very low power consumption.

One or more embodiments recognize and take into account that a type of conventional DOA estimator is based on using the main lobe of its beam pattern to scan the angles of interest. Such techniques usually require many microphones and a large array size to achieve the sharp beam width necessary for high resolution DOA estimation. Moreover, beam width is inversely proportional to working frequency, so that complex algorithms are required to maintain relatively constant performance over a wide frequency range.

One or more embodiments provide sharp nulls generated by several very compact microphone pairs to scan the angles of interest. Sharp nulls can be generated with a few closely spaced microphones, so that the physical format of the whole system is highly compact. Also, null position is independent of working frequency, so that a direction finding system based on nulls is very suitable for broadband applications.

In one or more embodiments, system 500 as shown in FIG. 5 is a 2-D array with two microphone pairs on the x and y axis. Such an array can eliminate DOA ambiguity within the x-y plane. However, it cannot discriminate the two DOAs that are symmetrical with respect to the x-y plane. This can be resolved by adding a third microphone pair on the z axis. The system and methods described above can be easily extended to the new 3-D array with microphone pair on all three axes. By adjusting the amount of delays, all three microphone pairs can have a common null in the 3-D space. The absolute value of the outputs of the three microphone pairs will then be added to remove any null that is not commonly shared by the three microphone pairs. The resultant microphone array has only one null in 3-D space, and can be used as the basic building block for a 3-D direction finding system.

Figure 6:
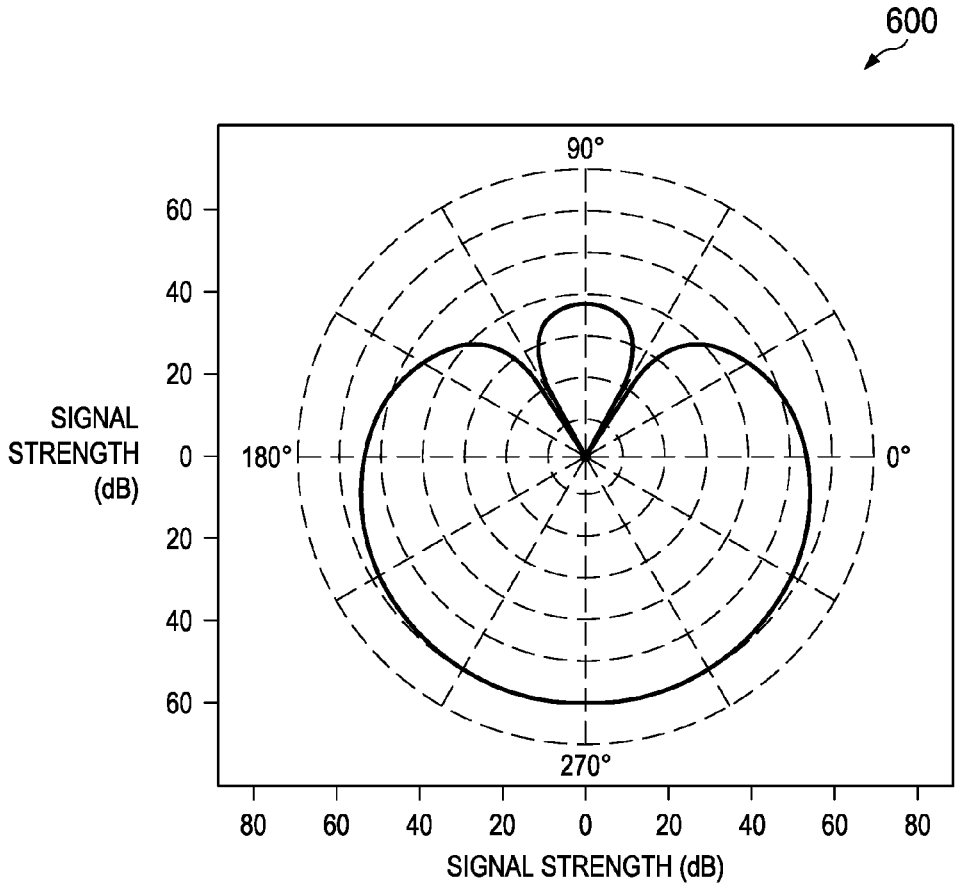
FIG. 6 is a graph of a beam pattern of an illustrative embodiment.

FIG. 6 shows a beam pattern, indicated generally at 600, of an illustrative embodiment. FIG. 6 illustrates beam pattern 600 where a second microphone pair (e.g., microphones 516 and 518 in FIG. 5) is used. Beam pattern 600 is plotted on an x-y graph with the signal strength (dB) along the y-axis, and the signal strength (dB) along the x-axis.

In an example, delay unit 504 and subtraction unit 508 as shown in FIG. 5 can be implemented for the second microphone pair (microphones 516 and 518) on the y-axis, and results in beam pattern 600. When nulls are generated at θ=60° and θ=120°, there is a signal entering through either one of the nulls.

Comparing beam pattern 300 and 600 shows that both beam patterns have a null at 60° and each has a second null at −60° and 120°, respectively. By adding the absolute value of the outputs from the two microphone pairs, a common null will be kept and the other two nulls will be removed.

Figure 7:
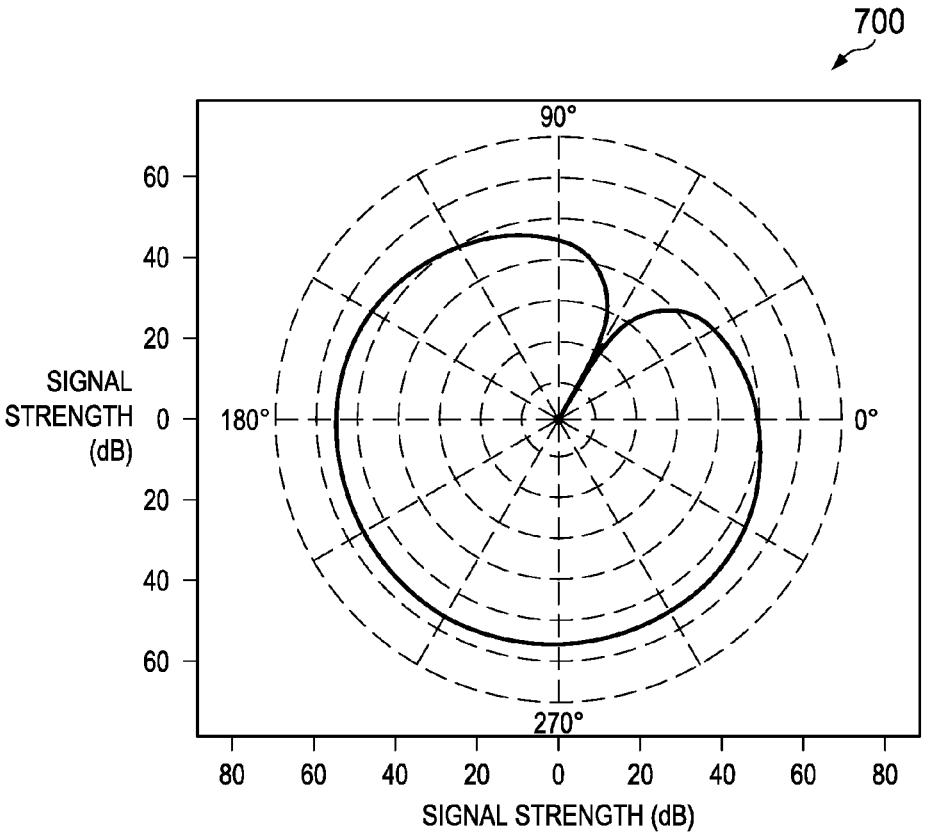
FIG. 7 is a graph of a beam pattern in accordance with another illustrative embodiment.

FIG. 7 shows a beam pattern, indicated generally at 700, of an illustrative embodiment. FIG. 7 illustrates beam pattern 700 where two microphone pairs (e.g., microphones 510 and 512 as a first pair and microphones 516 and 518 as a second pair, in FIG. 5) are used. Beam pattern 700 is plotted on an x-y graph with the signal strength (dB) along the y-axis and the signal strength (dB) along the x-axis.

Beam pattern 700 is a result of the system 500 as shown in FIG. 5. Beam pattern 700 only has one null at 60° and is the result of the addition of the absolute values from the outputs of subtractor units 506 and 508 of FIG. 5.

Figure 8A:
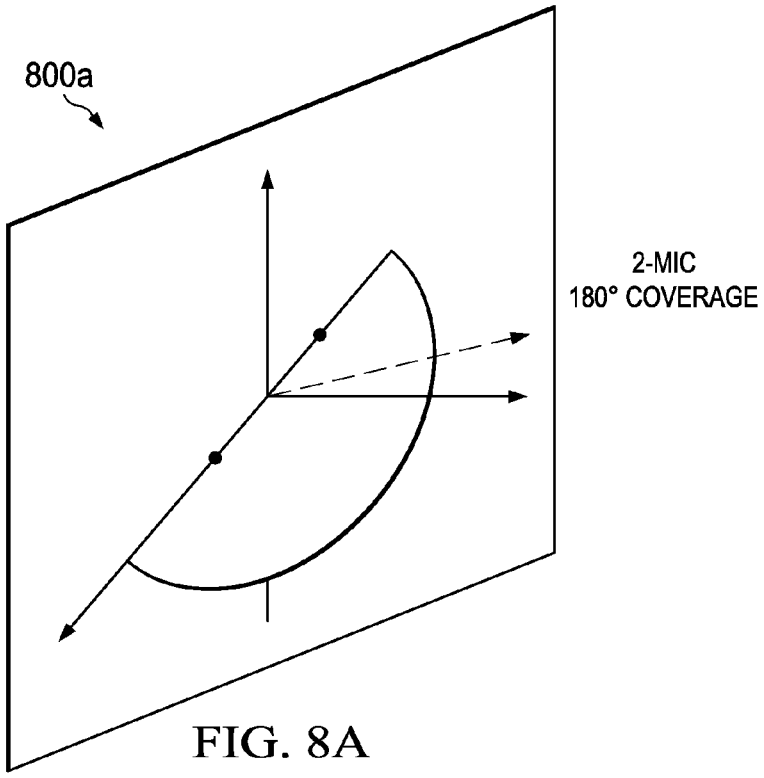
FIGS. 8A and 8B is a schematic view of a double pair of microphones with a two-dimensional array and double pair of microphones with a three-dimensional array of an illustrative embodiment.
Figure 8B:
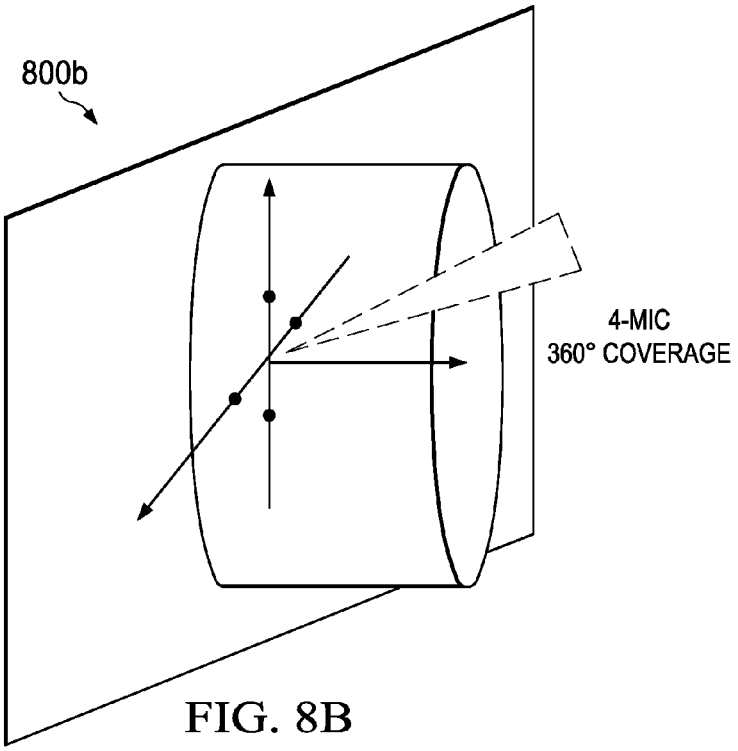

FIGS. 8A and 8B show a double pair of microphones with a two-dimensional array 800*a* and a double pair of microphones with a three-dimensional array 800*b* of an illustrative embodiment. Array 800*a* provides for 180 degrees of coverage in two dimensions while array 800*b* provides for 360 degrees of coverage in three dimensions.

Figure 9:
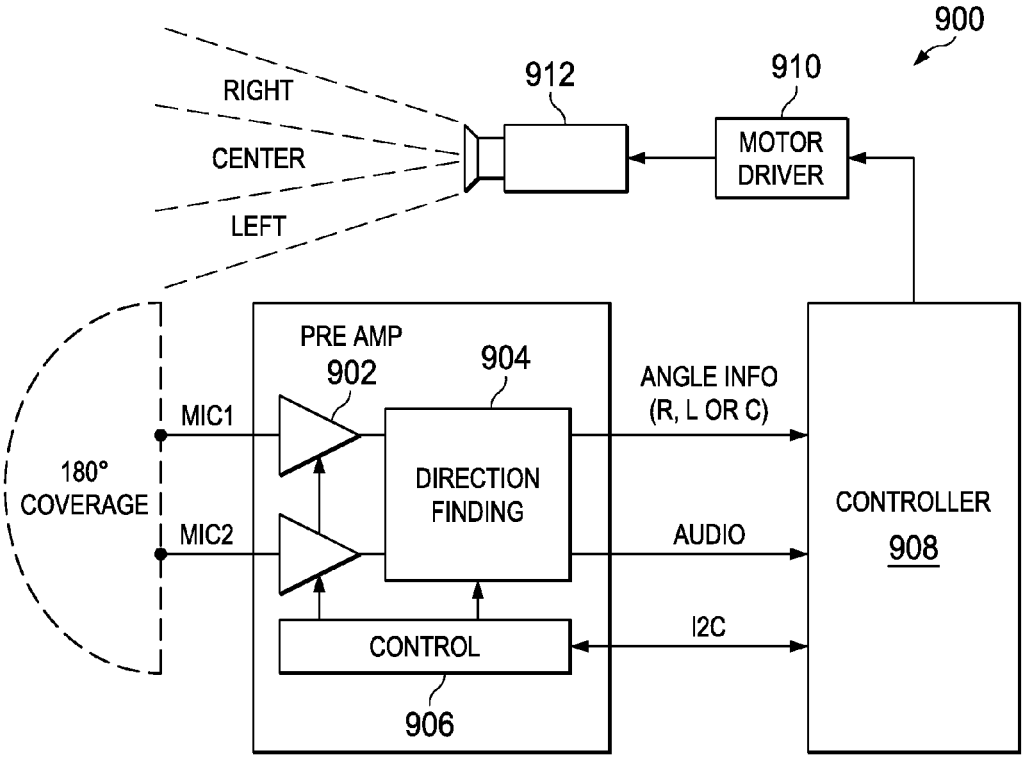
FIG. 9 is a block diagram a system with a microphone array controlling an angle of a camera of an illustrative embodiment.

FIG. 9 shows a system 900 with a microphone array controlling an angle of a camera of an illustrative embodiment. FIG. 9 illustrates system 900 where a single pair of microphones is used. In other examples, two or more pairs can be used. The system 900 includes mic 1 and mic 2, preamps 902, direction finding unit 904, control unit 906, controller 908, motor driver 910, and camera 912.

In an embodiment, system 900 is operable to obtain a direction of an audio signal from direction finding unit 904 and position an angle of camera 912 towards the audio signal. Mic 1 and mic 2 may represent microphones 202 and 204 as shown in FIG. 2. Preamps 902 are used to amplify the outputs of mic 1 and mic 2. Direction finding system 904 includes circuitry for delay units and subtractor units, such as the delay units and subtractor units shown in FIGS. 2 and 5. Control unit 906 is used to bias the settings of preamps 902 and direction finding unit 904.

Controller 908 can include one or more processors or other processing devices that control the overall operation of system 900. Controller 908 is operable to send a signal to motor driver 910 to move an angle of camera 912. In an example, controller 908 can communicate with control unit 906 through an integrated circuit bus and receive angle information and audio information from direction finding unit 904.

Figure 10:
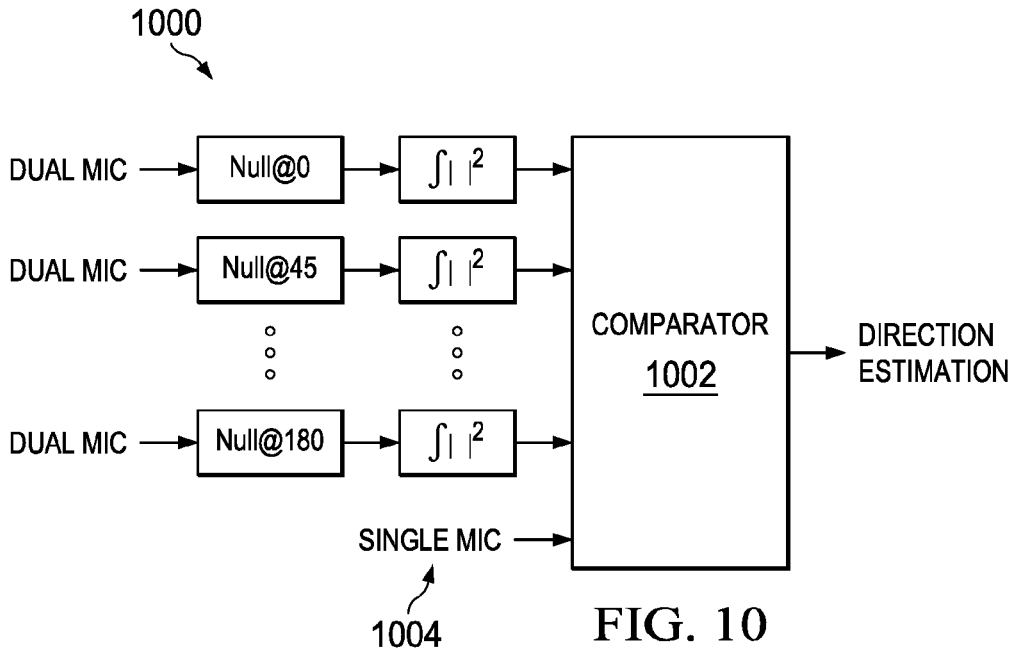
FIG. 10 is a block diagram a system with multiple null generating branches of an illustrative embodiment.

FIG. 10 shows a system 1000 with multiple null generating branches of an illustrative embodiment. FIG. 10 illustrates system 1000 where multiple feeds of a microphone pair go through different null generating branches. In each of these branches, a null at certain direction is formed to cancel signals coming from that direction; the energy of the remaining signal is then calculated and used as output of each branch. A comparator 1002 is used to compare the energy of each null generating branch with a reference energy level calculated from a single microphone to determine the direction of the sound event. If the energy level from a certain branch is substantially lower than the reference signal, the incoming signal is in the vicinity of the null direction corresponding to that branch.

Figure 11:
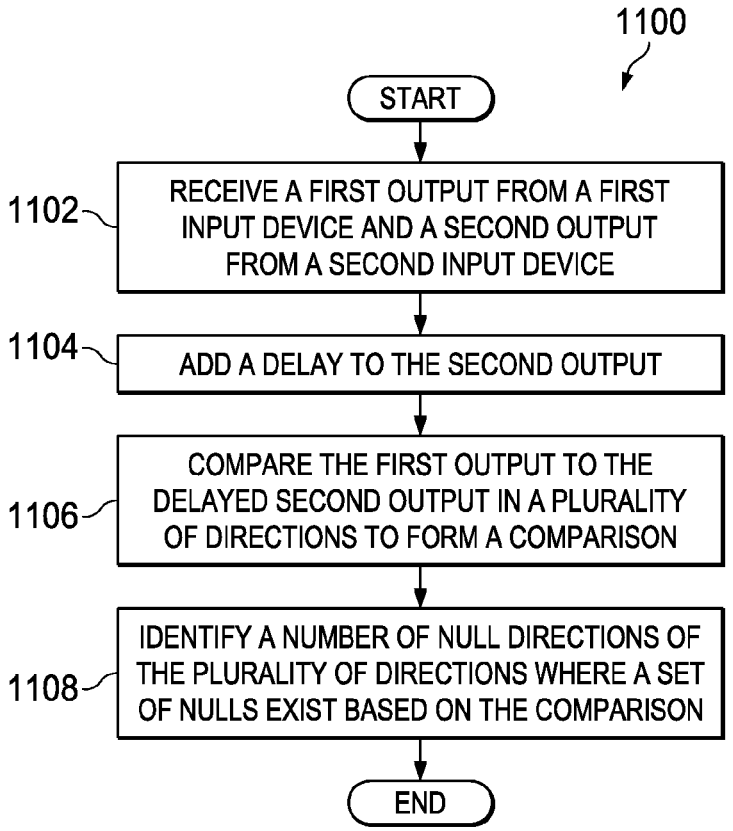
FIG. 11 is a flowchart of a process of the system of an illustrative embodiment.

FIG. 11 is a flowchart of a process 1100 of a system of an illustrative embodiment. The process is described with respect to system 200 as shown in FIG. 2; however the system may represent system 500 as shown in FIG. 5, or any other suitable system. The embodiment of the process 1100 shown in FIG. 11 is for illustration only. Other embodiments of the operation 1100 could be used without departing from the scope of this disclosure.

At step 1102, system 200 receives a first output from a first input device and a second output from a second input device. The first input device and second input device are microphones. In other examples, the input devices may be another type of sound sensing device. The first input device and second input device receive an audio signal from a source signal. The source signal may reach each input device at a different time. In an example, the input devices may monitor ambient sound at a particular location. The source signal may be coming from a new element creating a new sound within the range of the input devices.

At step 1104, system 200 adds a delay to the second output. The delay is used to match the first output to the second output for the audio signal from the source signal on each input device.

At step 1106, system 200 compares the first output to the delayed second output in a plurality of directions to form a comparison. By comparing, through subtracting, the two outputs signals, the sound coming from the source signal can create a null in the compared signal.

At step 1108, system 200 identifies a number of null directions of the plurality of directions where a set of nulls exists based on the comparison. When viewing a beam pattern, the nulls created indicate the direction from the source signal. In other examples, more pairs of input devices are combined with this pair to further define the direction.

In an example embodiment, a microphone pair consists of two closely placed microphones that can generate sharp and steerable nulls by first adding an appropriate amount of delay in the microphone outputs and then subtracting the two microphone outputs. The spacing of the microphones is less than the wavelength of the highest frequency of interest. Usually, the spacing is around a few centimeters, resulting in a very compact array structure, and covers a large range of audible frequency range.

One or more embodiments provide a method that combines the two or more microphone pairs in the above example embodiment to form 2-D and 3-D arrays to reduce the DOA ambiguity. This is achieved by adjusting the delay amount in the microphone outputs so that different microphone pairs have a null in common and nulls that are not in common can be removed by adding the absolute value of outputs from the microphone pairs.

One or more embodiments provide a direction finding system based on the microphone pair as described above that continuously monitors the output level of all null-generating blocks and uses the knowledge that the signal entering a certain null will be greatly reduced as a basis to further estimate signal's DOA.

One or more embodiments provide a digital implementation of the system above that uses analog to digital converters to convert the microphone signal to digital samples and then implements the null-generating blocks and direction finding algorithm digitally.

One or more embodiments provide an analog implementation of the method above, which implements the null-generating blocks and direction finding system using analog circuits. A mixed of digital and analog processing can also be used to implement the direction finding system.

Although illustrative embodiments have been shown and described by way of example, a wide range of alternative embodiments is possible within the scope of the foregoing disclosure.

What is claimed is:

1. A device for identifying a direction of a sound, the device comprising:

a controller comprising circuitry, the circuitry configured to:

receive a first output from a first input device and a second output from a second input device;

add a delay to the second output;

compare the first output to the delayed second output in a plurality of directions to form a comparison; and identify a number of null directions of the plurality of directions where a set of nulls exists based on the comparison.

2. The device of claim 1, wherein the first input device is separated from the second input device by a distance, the circuitry further configured to:

identify a delay based on the distance between the first input device and the second input device.

3. The device of claim 1, wherein to compare the first output to the delayed second output in the plurality of directions, the circuitry is further configured to:

subtract the delayed second output from the first output.

4. The device of claim 1, wherein the distance between the first input device and second input device is less than a wavelength of a threshold frequency.

5. The device of claim 1, wherein the comparison is a first comparison, and the circuitry further configured to:

receive a third output from a third input device and a fourth output from a fourth input device, wherein the third input device is separated from the fourth input device by a second distance;

identify a second delay based on the second distance between the third input device and the fourth input device;

adding the second delay to the fourth output;

compare the third output to the delayed fourth output in the plurality of directions to form a second comparison;

add the first comparison to the second comparison to form a total comparison; and identify a number of second null directions of the plurality of directions where a second set of nulls exists based on the total comparison.

6. The device of claim 5, wherein to identify the number of second null directions of the plurality of directions where the second set of nulls exists based on the total comparison, the circuitry is further configured to:

identify a first null of the set of nulls in common with a second null from the second set of nulls.

7. The device of claim 6, wherein to identify the first null of the set of nulls in common with the second null from the second set of nulls, the circuitry is further configured to:

add absolute values of the first comparison and the second comparison.

8. The device of claim 1, the circuitry further configured to:

receive a first audio signal at the first input device and a second audio signal at the second input device.

9. The device of claim 5, wherein to add the first comparison to the second comparison to form the total comparison, the circuitry is further configured to:

add the first comparison to the second comparison and a third comparison to form the total comparison; and identify a number of third null directions of the plurality of directions where a third set of nulls exists in three dimensions based on the total comparison.

10. The device of claim 1, the circuitry further configured to:

adjust an angle of a camera based on the number of directions.

11. A method of identifying a direction of a sound, the method comprising:

receiving a first output from a first input device and a second output from a second input device;

adding a delay to the second output;

comparing the first output to the delayed second output in a plurality of directions to form a comparison; and identifying a number of null directions of the plurality of directions where a set of nulls exists based on the comparison.

12. The method of claim 1, wherein the first input device is separated from the second input device by a distance, the method further comprising:

identifying a delay based on the distance between the first input device and the second input device.

13. The method of claim 11, wherein comparing the first output to the delayed second output in the plurality of directions comprises:

subtracting the delayed second output from the first output.

14. The method of claim 11, wherein the distance between the first input device and second input device is less than a wavelength of a threshold frequency.

15. The method of claim 11, wherein the comparison is a first comparison, and further comprising:

receiving a third output from a third input device and a fourth output from a fourth input device, wherein the third input device is separated from the fourth input device by a second distance;

identifying a second delay based on the second distance between the third input device and the fourth input device;

adding the second delay to the fourth output;

comparing the third output to the delayed fourth output in the plurality of directions to form a second comparison;

adding the first comparison to the second comparison to form a total comparison; and identifying a number of second null directions of the plurality of directions where a second set of nulls exists based on the total comparison.

16. The method of claim 15, wherein identifying the number of second null directions of the plurality of directions where the second set of nulls exists based on the total comparison further comprises:

identifying a first null of the set of nulls in common with a second null from the second set of nulls.

17. The method of claim 16, wherein identifying the first null of the set of nulls in common with the second null from the second set of nulls comprises:

adding absolute values of the first comparison and the second comparison.

18. The method of claim 11, further comprising:

receiving a first audio signal at the first input device and a second audio signal at the second input device.

19. The method of claim 15, wherein adding the first comparison to the second comparison to form the total comparison comprises:

adding the first comparison to the second comparison and a third comparison to form the total comparison; and identifying a number of third null directions of the plurality of directions where a third set of nulls exists in three dimensions based on the total comparison.

20. The method of claim 11, further comprising:

adjusting an angle of a camera based on the number of directions.

* * * * *